United States Patent [19]

Dowzall

[11] Patent Number: 4,542,039

[45] Date of Patent: Sep. 17, 1985

[54] PRODUCTION OF COLORED LEGENDS

[75] Inventor: Martin E. Dowzall, Wyckoff, N.J.

[73] Assignee: Esselte Pendaflex Corporation, Garden City, N.Y.

[21] Appl. No.: 625,042

[22] Filed: Jun. 27, 1984

[30] Foreign Application Priority Data

Jul. 5, 1983 [GB] United Kingdom ..... 8318162

[51] Int. Cl.[4] ..... B41M 5/00

[52] U.S. Cl. ..... 427/149; 427/261; 427/265; 427/288; 427/421; 427/427

[58] Field of Search ..... 427/149, 288, 261, 265, 427/421, 427

[56] References Cited

U.S. PATENT DOCUMENTS

| | | | |
|---|---|---|---|
| 1,003,836 | 5/1931 | Bihr | 427/149 |
| 1,260,792 | 3/1918 | Palm | 427/149 |
| 1,618,612 | 2/1927 | Tull | 427/149 |
| 1,998,638 | 4/1935 | Reese | 427/149 |
| 4,444,839 | 4/1984 | Dudzik et al. | 427/149 |

FOREIGN PATENT DOCUMENTS

| | | |
|---|---|---|
| 0092359 | 4/1982 | European Pat. Off. . |
| 058066 | 8/1982 | European Pat. Off. . |
| 8302089 | 2/1983 | Int'l Pat. Institute . |

*Primary Examiner*—Norman Morgenstern
*Assistant Examiner*—Janyce A. Bell
*Attorney, Agent, or Firm*—Darby & Darby

[57] ABSTRACT

Colored legends are produced using a combination of dry transfer, preferably white, lettering, and the application of color thereto. The dry transfer is placed on an intermediate carrier to form the desired legend, the legend then e.g. sprayed over with colors, preferably using a felt tip marker as color source, or colored using a hot blocking foil and the so colored legend then lifted using an adhesive web and liquid treatment of the intermediate carrier to release the legend therefrom and positioned where desired on the final receptor. The adhesive web is then removed to leave the desired legend in the desired color.

5 Claims, No Drawings

PRODUCTION OF COLORED LEGENDS

This invention relates to the production of coloured legends.

In recent years substantial use has been made in the graphic arts field of dry transfer lettering sheets. These consist generally of a transparent or translucent carrier sheet having formed thereon, usually by screen printing, a plurality of transferable indicia such as alphabetic letters, numerals, punctuation marks and the like (all for simplicity embraced by the term "lettering" as used herein). The sheets are available in a wide variety of type sizes and typefaces, mostly printed in black ink. Although several major manufacturers also make a variety of the sheets available in white ink, and for particularly popular typefaces in a range of coloured inks, the flexibility in terms of colour is often inadequate from the graphic artists' point of view. However the manufacture of such sheets in a wide variety of colours would be wholly impractical and uneconomic.

Suggestions have been made for techniques to overcome this problem. For example it has been suggested to dye or stain white lettering while still on a dry transfer sheet and subsequently transfer the indicia to the desired receptor. Alternatively, systems involving using the dry transfer letter as a masking medium, and subsequently removing the lettering with adhesive tape have been suggested. All the systems heretofore proposed have failed commercially to gain any widespread acceptance.

We have now found that by a specific combination of individually known techniques, a legend formed of coloured lettering may be produced on a desired receptor surface where the variety of type sizes and typefaces available is as wide as that available in dry transfer and where the range of colour availability is very substantial.

According to the present invention there is provided a method of making a coloured legend on a desired receptor surface in coloured lettering which comprises

- forming on an intermediate receptor surface, using indicia from dry transfer material, the desired legend,
- applying a desired colouration to the legend by applying colouring material thereon,
- applying an adhesive web to the legend,
- applying liquid to the intermediate receptor surface from its rear face whereby to weaken the bond between the indicia forming the legend and the surface of the intermediate receptor to less than the bond between the indicia and the adhesive web,
- peeling the adhesive web bearing the indicia away from the intermediate receptor surface and positioning it over the desired final receptor surface,
- applying pressure from the back of the adhesive web to cause the indicia to adhere to the final receptor surface, and
- peeling away the adhesive web to leave the indicia adhered to the final receptor surface.

The basic process of applying a legend to an intermediate carrier and removing it therefrom for subsequent application to the desired final receptor is fully and completely described in published European Patent Application No. 0058066, the whole of the disclosures of which are incorporated herein by reference. In accordance with the present invention that basic legend selection, assembly and transference process is supplemented by a colouring step, the colouring being applied while the legend is on the intermediate carrier.

The preferred method of colour application is by spraying colourant material on to the legend. Spraying is quick and simple, and where colouring is applied outside the area of the letters or numbers of the legend, this is simply left on the intermediate carrier when the legend is removed by the adhesive web, and the carrier then discarded. Spray application of colour may take place in a variety of ways but it is of course important to ensure that the colouring material is not one which serves to attach the legend irremovably to the intermediate receptor, or which would damage the legend. A highly preferred method is to spray colouring material on to the legend using an air brush, most preferably using an air brush of the type consisting simply of an air supply and jet arranged to spray colourant liquid from a capillary fed tip such as the end of a technical pen or the end of a felt tip marker. In a particularly preferred way of putting the invention into effect, the application of colour is by spraying from the end of a felt tip marker onto a legend formed basically in white dry transfer lettering. Very even colour application may be effected in this way. Apparatus operating in this fashion is described in European Patent Publication No. 0092359, the whole of the disclosures of which are incorporated herein by reference. Care should be taken to ensure that the sprayed material does not contain any solvent which would affect the letters forming the legend. Accordingly, generally speaking, use of spray colours or felt tip markers including xylene as a solvent should be avoided, and preference given to water or alcohol based materials. Spraying may be overall or selective, e.g. using masking techniques to produce special effects such as striped letters.

An alternative to spraying, though generally less preferred, is to apply a hot marking foil to the legend. Such marking foils are commercially available in a wide variety of colours. Provided the temperature and pressure of application are not too high, after application of such a foil to the legend, the foil can be peeled away leaving a coloured coating adhered only to the letters forming the legend, and not adhered to the intermediate carrier sheet. Due to the limited covering power of coatings on some foils, this technique is preferably avoided when the legend is formed of black ink letters, but can be used very effectively in the case of white letter legends. International Patent Publication No. W083/02089 describes a method of using blocking foil selectively this way.

Thus by using a combination of known techniques, legends may be produced in a very wide variety of colours easily and flexibly by the graphic artist. Kits for operating the process described in European Patent Application No. 0058066 are available commercially under the designation WP4 Word Positioning System, manufactured by Letraset Limited. A wide variety of felt tip marking devices in colour ranges is known, well known brands being commercially available under the registered trade marks PANTONE, MAGIC MARKER, and DESIGN MARQUETTE. Suitable hot marking foils are available from specialist manufactuers.

I claim:

1. The method of making a colored legend on a desired receptor surface in colored lettering which comprises forming the desired legend by a selectively applying dry transfer indicia from a dry transfer sheet bearing such indicia to a porous intermediate receptor surface, applying a coloring material to the surface of the legend on said intermediate receptor, applying an adhesive web to the legend, applying liquid to the rear face of the intermediate receptor surface to reduce the strength of the bond between the indicia forming the legend and the surface of the intermediate receptor to less than the strength of the bond between the indicia and the adhesive web, peeling the adhesive web bearing the indicia away from the intermediate receptor surface and positioning said web over the desired final receptor surface;

applying pressure to the back surface of the adhesive web to cause to the indicia forming the legend to adhere to the final receptor surface, and withdrawing the adhesive web to leave the indicia forming the legend adhered to said final receptor surface.

2. The method of claim 1 which comprises applying said coloring material in the form of a particulate spray.

3. The method of claim 2 wherein said spraying step comprises dispensing a spray of colorant liquid from a capillary fed tip by means of an air jet.

4. The method of claim 1 which comprises applying said coloring material from a hot blocking foil.

5. The method of claim 1 wherein said legend comprises white printed dry transfer material.

* * * * *